US005311761A

United States Patent [19]

Robbins

[11] Patent Number: 5,311,761

[45] Date of Patent: May 17, 1994

[54] METAL EXTRUSION DUMMY BLOCK HAVING A SPRING LOADED VALVE

[75] Inventor: Paul H. Robbins, Aurora, Canada

[73] Assignee: Exco Technologies, Limited, Markham, Canada

[21] Appl. No.: 947,167

[22] Filed: Sep. 18, 1992

[51] Int. Cl.[5] ..... B21C 26/00

[52] U.S. Cl. ..... 72/273

[58] Field of Search ..... 72/273, 273.5, 272, 72/253.1

[56] References Cited

U.S. PATENT DOCUMENTS

| | | | |
|---|---|---|---|
| 2,904,830 | 9/1959 | Mulrooney | 72/273 |
| 3,282,075 | 11/1966 | Zhookoff . | |
| 3,385,091 | 5/1968 | Hess | 72/273 |
| 3,581,544 | 6/1971 | Grimes | 72/253.1 |
| 3,616,672 | 11/1971 | Moos . | |
| 3,820,374 | 6/1974 | Braeuninger | 72/265 |
| 3,826,122 | 7/1974 | Braeuninger | 72/264 |
| 3,908,427 | 9/1975 | Wozniak et al. | 72/273 |
| 3,919,873 | 11/1975 | Biswas et al. | 72/273 |
| 4,024,743 | 5/1977 | Decours et al. | 72/273 |
| 4,052,877 | 10/1977 | Zilges et al. | 72/273 |
| 4,212,182 | 7/1980 | Steyvers et al. | 72/273 |
| 4,286,453 | 9/1981 | Exner | 72/273 |
| 4,342,212 | 8/1982 | Sibler | 72/273.5 |
| 4,550,584 | 11/1985 | Degen | 72/273 |
| 4,714,423 | 12/1987 | Hattori et al. | 72/273 |
| 5,048,592 | 9/1991 | Mueller | 164/312 |
| 5,054,303 | 10/1991 | Newman | 72/273 |

FOREIGN PATENT DOCUMENTS

| | | | |
|---|---|---|---|
| 1190518 | 7/1985 | Canada . | |
| 1032206 | 6/1958 | Fed. Rep. of Germany | 72/273 |
| 0954126 | 4/1964 | United Kingdom | 72/273 |

*Primary Examiner*—Daniel C. Crane
*Attorney, Agent, or Firm*—Basile and Hanlon

[57] ABSTRACT

An extrusion press for extruding extrudable metals through a die by use of a dummy block, the addition of a mechanical venting device to vent gases from the container. The venting device has:

i) a circular shaped valve member provided in a front face of the dummy block, the valve member is moveable inwardly and outwardly of the dummy block from an open venting position to a closed position, ii) a channel is provided in the dummy block and leads away therefrom to vent gases away from the valve in the open position, iii) a spring is provided for biasing the valve member to the open position, iv) the spring resists movement of the valve member toward the closed position by virtue of the dummy block moving into the container and the valve member contacts a metal billet in the container and is thereby urged toward the closed position, v) the spring has a present resistance value which resists movement of the valve member to the closed position at least until a metal billet in the container commences to upset and flow within the container at which moment force on the valve member due to the dummy block advancing into the container exceeds the resistance value of the biasing means. In this manner the valve is retained in the open position until the last possible moment to vent gases from the container.

7 Claims, 5 Drawing Sheets

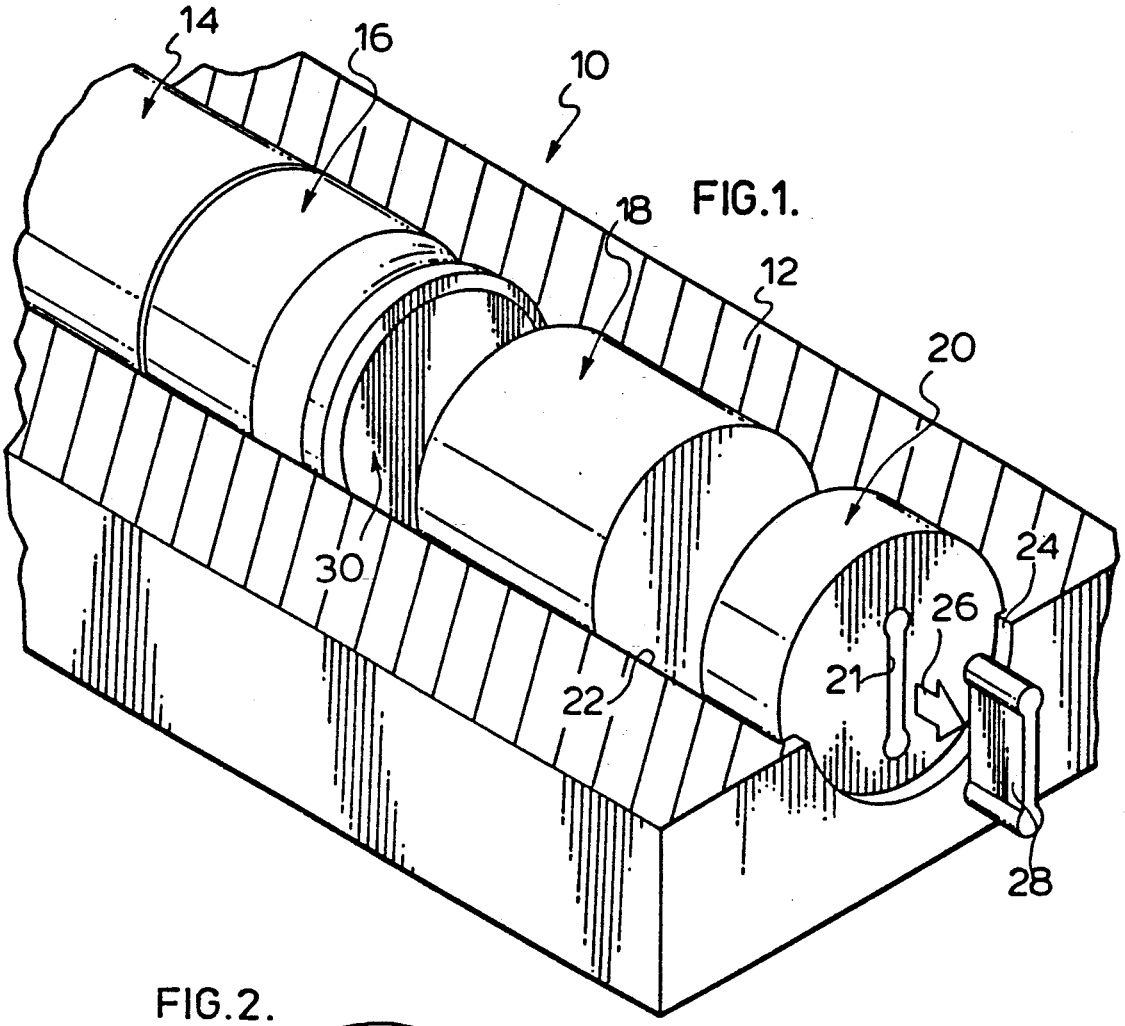
FIG.1.
FIG.2.
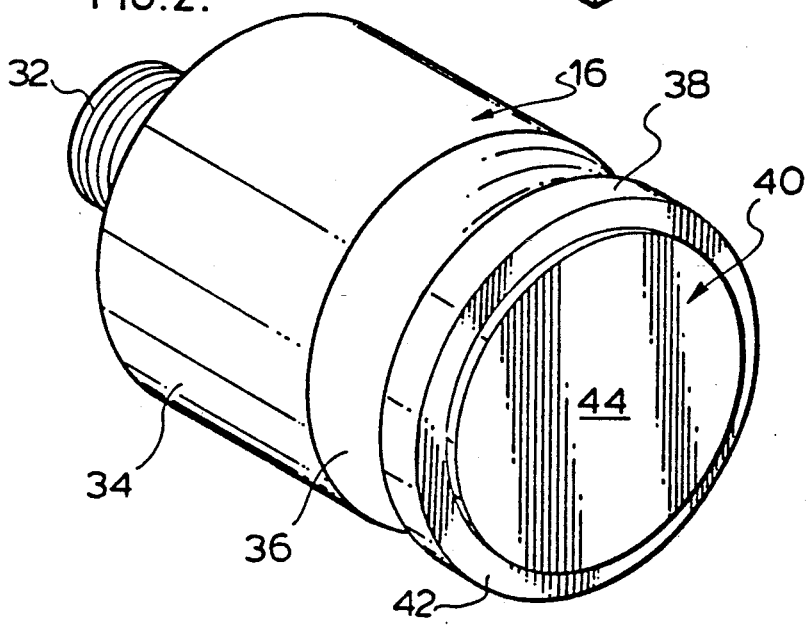

METAL EXTRUSION DUMMY BLOCK HAVING A SPRING LOADED VALVE

FIELD OF THE INVENTION

This invention relates to the mechanical venting of gases from within a container during startup of an extrusion press for extruding metal billets.

BACKGROUND OF THE INVENTION

It is common to extrude malleable metals to form a variety of longitudinally extending shapes. Common metals to be extruded are various aluminum alloys, copper, copper alloys, including brass and bronze, lead and various alloys of lead. In a normal extrusion press the metal is pressed through a die which determines the cross-sectional shape of the extrusion. The metal is normally extruded on a batch basis where a metal billet is inserted in a container of the extruder. The metal billet is preheated to a temperature proximate its plastic point. The metal billet is then upset in the container by a stem entering the container and compressing the billet within the container. Upon upset and flow of the metal, an extrusion is formed through the one or more dies in the extrusion press. In order to protect the end of the stem from contacting the metal billet a dummy block is commonly used. The dummy block is either attached to or in some way positioned in advance of the stem to contact the metal billet and space the end of the stem from the billet. An example of a dummy block as fixed to the stem is shown in U.S. Pat. No. 3,385,091. The dummy block is threaded onto the stem and may be removed therefrom for replacement and/or repair. It is also common however to use dummy blocks which are detachable from the stem. An example of that type of system is disclosed in U.S. Pat. No. 3,616,672. After the dummy blocks are ejected from the container they may be retrieved for re-use by a retrieving mechanism such as shown in U.S. Pat. No. 3,581,544.

A problem is often encountered in centering the dummy block with the stem of the extrusion press. U.S. Pat. No. 4,286,453 discloses a locating peg on the face of the stem which is resiliently mounted on the stem. Should the bore in the dummy block which receives the peg not be aligned with the stem during positioning of the dummy block in the container, the peg is pushed back into the stem until alignment is achieved. This resilient mounting of the peg avoids damaging thereof during the location of the dummy block within the container.

Canadian patent 1,190,518 discloses a dummy block which has a extendable mandrel located in its face. The mandrel is tapered inwardly such that when pressed into the dummy block, it causes the dummy block to expand to the diameter of the container cylinder. The mandrel is designed to be flushed with the face of the dummy block to minimize wastage in the discarded butt portion of the metal billet.

Special shapes for the mandrel within the dummy block may also be provided particularly with respect to the extrusion of tubing. A special mandrel shape for use in tube extrusion is described in U.S. Pat. No. 3,820,374. The mandrel is secured within the dummy block and onto the stem or ram portion of the extrusion press.

In the operation of these extrusions presses it is generally understood that gases which occupy the voids in the container during press startup need to be released before the metal is extruded. This is commonly known as the degas or burp cycle of the extrusion press. The degas cycle requires the opening of the press after the aluminum or other metal alloy billet is upset in the container at approximately half of the required extrusion pressure. After opening of the extrusion press to release the gases, the die container and ram are repositioned to complete the extrusion process of the batch of metal. An attempt has been made to eliminate this degas cycle in the manner disclosed in U.S. Pat. No. 5,054,303. The container is subjected to vacuum to remove gases from within the spaces in the container. The vacuum is applied to the container through a hollow stem of the extrusion press and via the extendible mandrel of the dummy block. The system is satisfactory from the standpoint of withdrawing gases from the container prior to upset of the billet. However, since the mandrel is free to move within the dummy block, as soon as any pressure is exerted on the dummy block the mandrel moves into the dummy block to expand the dummy block to the diameter of the container cylinder. At that time no further gases are evacuated from the container cylinder. A further drawback in applying a vacuum to the container is the potential of breakdown and the electronic controlling of the valving arrangements to provide a vacuum during startup. During shutdown, pressure gases may be applied to eject the mandrel from the dummy block at the end of the extrusion cycle.

The dummy block design of this invention overcomes a number of the above problems by providing a valve member which is mechanically positioned to achieve a venting of the container at least until upset of the metal billet in the container. Such valving arrangement may be used as a supplement to the standard degas portion of the cycle.

SUMMARY OF THE INVENTION

The invention is used in any type of extrusion press for extruding through a die extrudable metals. The mechanical venting device is provided in a circular dummy block for venting gases from a circular container at least until upset of a metal billet in the container. The venting device comprises:

i) a circular shaped valve member provided in a front face of the dummy block, the valve member is movable inwardly and outwardly of the dummy block from an open venting position to a closed position, ii) channel means is provided in the dummy block and leads away therefrom to vent gases away from the valve in the open position, iii) the valve member has a sealing face which seals against a mating face of the dummy block, iv) the dummy block has means for guiding movement of the valve member into and out of the closed position, v) means is provided for resiliently mechanically biasing the valve member to the open position, vi) the mechanical biasing means resists movement of the valve member towards the closed position by virtue of the dummy block moving into the container and the valve member contacting a metal billet in the container and thereby is urged toward the closed position, vii) the mechanical biasing means has a pre-set resistance value which resists movement of the valve member to the closed position at least until a metal billet in the container commences to upset and flow within the container at which moment force on the valve member due to the dummy block advancing into the container exceeds compressive load of the biasing means.

In this manner the valve is retained open until the last possible moment to vent gases collecting at least within the rear region of the container.

BRIEF DESCRIPTION OF THE DRAWINGS

Preferred embodiments of the invention are shown in the drawings wherein:

FIG. 1 is a perspective view of an extrusion press with a portion of the container removed to show the die, billet, dummy block and extrusion ram.

FIG. 2 is a perspective view of the dummy block according to this invention.

DETAILED DESCRIPTION OF THE PREFERRED EMBODIMENTS

Figure 3:
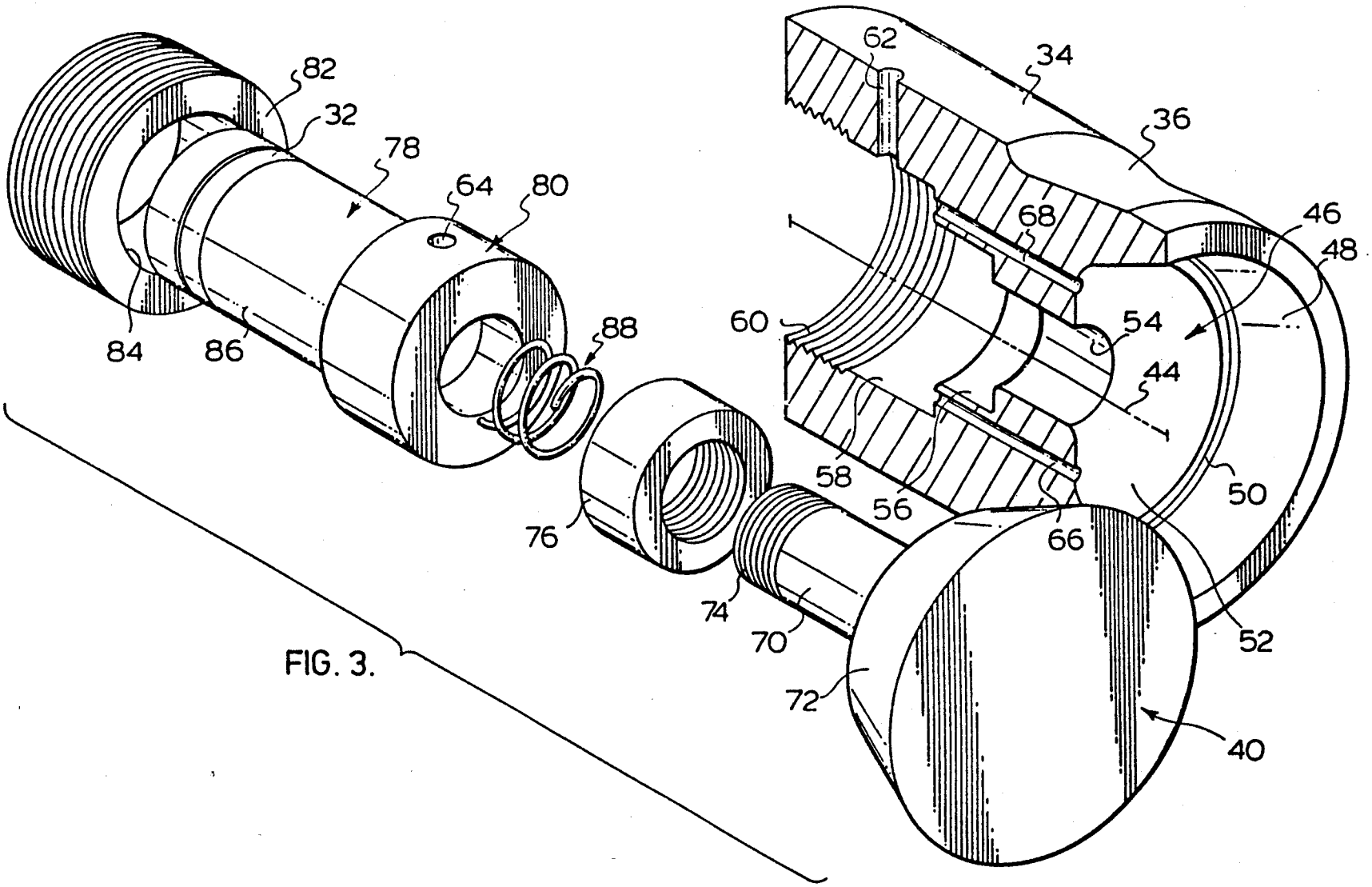
FIG. 3 is an exploded view of the dummy block of FIG. 2.

A representation of an extrusion press is shown in FIG. 1. The extrusion press 10 has a container 12 which has its upper portion cut away to show the positioning of the extrusion stem 14, the dummy block 16, the metal billet 18 and the extrusion die 20. These elements are all nestled in the container 12 which has a cylindrical wall 22. The die 20 is held in position in a normal manner, as schematically illustrated by the lip portion 24. As the stem 14 is advanced in the container 12 the metal billet 18 is extruded through die 20 in the direction of arrow 26 to produce the longitudinally extending extrusion 28. In order to protect the stem 14 the dummy block 16 is positioned between the stem and the billet 18. The face generally designated 30 contacts the billet 18 and under the pressure of the stem 14 presses the metal billet through the die 20. The dummy block 16, as shown in FIG. 2, has a threaded connector 32 for securing the dummy block to the stem 14 in a manner which will be discussed in more detail in FIG. 4. The body portion 34 of the dummy block has a recessed groove 36 provided therein. This allows for expansion of the annular portion 38 of the dummy block in the outward direction in the manner to be discussed with respect to FIG. 5. A valve generally designated 40 is provided in the face 42 of the dummy block. The valve has a face portion 44. The valve is shown in FIG. 2 in its outward open position. When the valve is moved to its closed position, face 44 is flush with face 42 of the dummy block.

The construction of the dummy block is shown in more detail in FIG. 3. The body portion 34 of the dummy block has an axially extending bore of several complex surfaces symmetrical about the longitudinal axis 44 of the dummy block. The recessed portion 46 comprises an inwardly sloped surface 48 which is sloped toward the central axis 44. A radiused portion 50 leads into a bottom annular portion 52 of the recess 46. A bore 54 extends through the bottom 52 of the recess 46. Rearwardly of the bore 54 are progressively larger bores 56 and 58. Bore 58 has an internally threaded portion 60. At least one keyhole 62 is provided through the body portion 34 of the dummy block. Extending rearwardly from the bottom 52 of the recess 46 are at least two vent channels 66 and 68. Normally six vent channels are provided in the dummy block to readily accommodate the flow of gases from the extrusion container in a manner to be discussed with respect to FIG. 7.

The valve member 40 is designed to fit within the recessed portion 46 and have its rearwardly extending post 70 extending through bore 54. The valve member 40 has an undercut surface 72 which is sloped to mate with the sloping surface 48 of the recess 46 where the valve in its closed position is shut off by the engagement of surfaces 72 and 48. The valve post 70 has a threaded end portion 74 onto which threaded collar 76 is positioned. Threaded collar 76 fits within enlarged bore 56 to position the valve member 40 in the recess 46.

Figure 4:
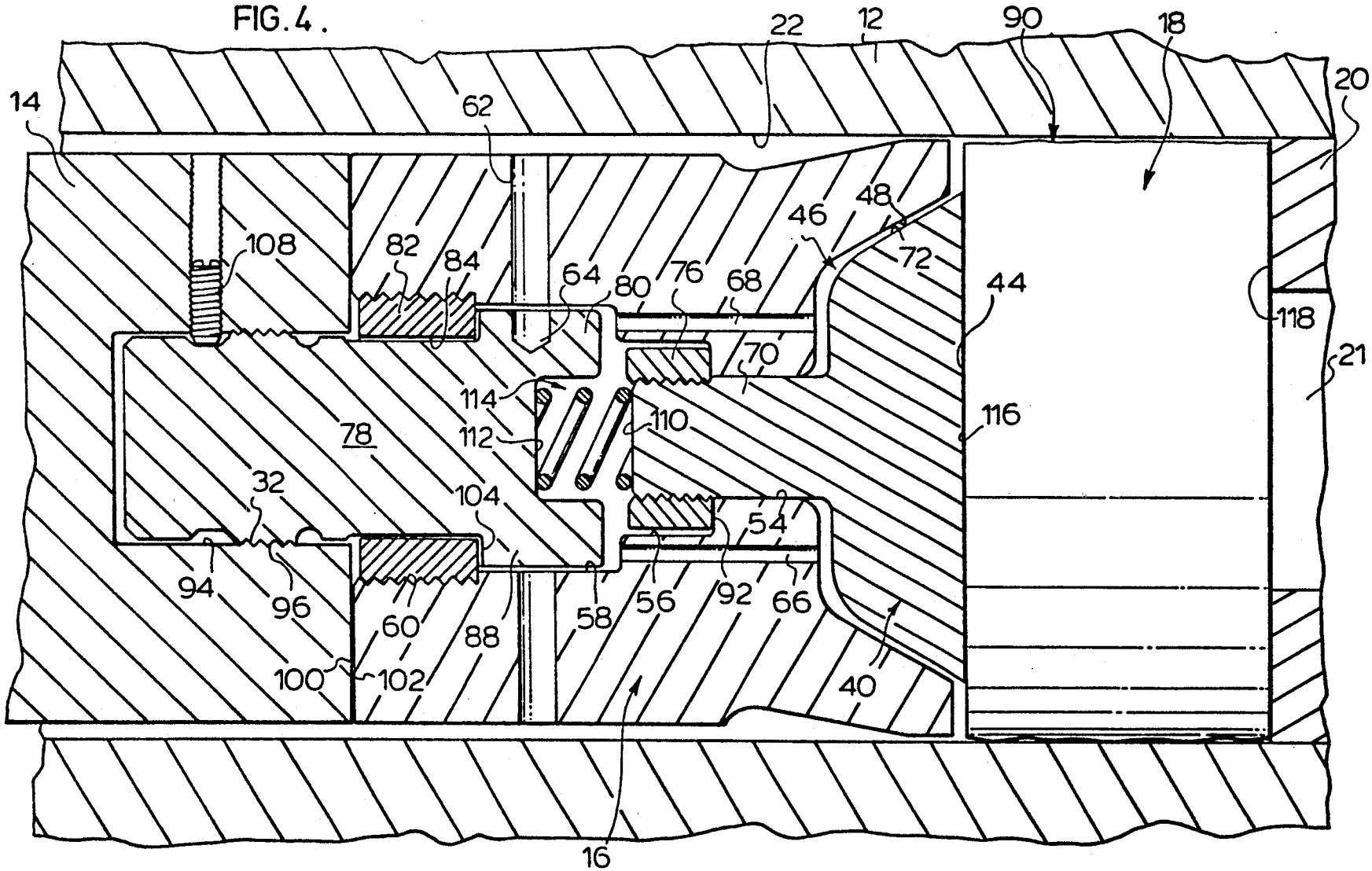
FIG. 4 is a section through the dummy block of this invention positioned within a container and in the startup position.

A stud 78 threaded within the stem in the manner shown in FIG. 4 has an enlarged annular portion 80. The enlarged portion 80 has at least one blind hole 64 which can be brought into alignment with keyhole 62. A rod can be inserted through keyhole 62 and into blind hole 64 to turn the stud 78 with the dummy block during threading of the stud 78 into the stem 14. An externally threaded collar 82 has a cylindrical bore 84 which fits over the shaft 86 of the stud 78 to abut the annular flange 80. The externally threaded collar 82 is used to position the dummy block relative to the stud. Externally threaded collar 82 is threaded into the thread of bore 58.

According to this invention, a compression spring 88 is positioned between the valve member 40 and the stud 78 to retain the valve member 40 in the open position to the extent which will be discussed with respect to FIGS. 4 and 5.

In FIG. 4 the cylindrical bore 22 of the container 12 is of constant diameter. The metal billet 18 is in the shape of a cylinder having a diameter slightly less than the diameter of the cylinder bore 22 and hence, defining the space designated 90. The die 20 fits snugly within the interior of the cylinder 22 to define an end portion for the cylinder 12. The die 20 has the opening 21 which defines the shape of the metal extrusion 28 shown in FIG. 1. The metal billet 18 is loaded into the container 12 at an elevated temperature which is close to the temperature at which the billet under pressure upsets and commences to flow. The purpose of the stem 14, as located within the container 12 is to advance the dummy block 16 so as to upset the metal billet and commence extrusion of the metal through the die 20. As already explained however, the space 90 between the metal billet and the wall of the cylinder 22 can entrap gases if the extrusion press is not run through the normal degas cycle. The valve member 40 in the dummy block 16 complements the degas cycle by continuing to provide for mechanical venting of the gases from the spaces in the cylinder up to and including upset of the billet conforming to the walls of the container, as will be discussed with respect to FIG. 5.

The bore 54 within the dummy block is sized to receive the post 70 of the valve member 40. The dimensioning of the post and bore is such to provide for telescopic movement of the valve member 40 during temperatures of operation of the dummy block. Hence, the relative thermal expansion of the materials of the dummy block 16 and post 70 are taken into consideration. The threaded collar 76 is positioned on the post 70 to locate the extent of outward movement of the valve member 40 relative to the recess 46. The collar 76 is positioned within enlarged bore 56 and is seated against shoulder 92 which is defined between bores 54 and 56. The extent to which the collar 76 is threaded onto post 70 determines the open position, that is, the open position of the valve member 40 in the dummy block.

The stem 14 has a centrally located bore 94 having an internal threaded portion 96. The threaded portion 96 engages the threaded portion 32 of the stud 78. The stud 78 is threaded into the bore 94 by use of a rod extending through keyhole 62 and into blind hole 64, to the extent shown which defines the spacing between front face 100 of the stem and rear face 102 of the dummy block where such spacing is shown in more detail in FIG. 6. The spacing between faces 100 and 102 is determined by the positioning of the externally threaded collar 82 as threaded onto threaded portions 60 of the dummy block. The collar engages shoulder 104 of the stem with the collar 82 advanced to the extent shown to define the desired space between faces 100 and 102 of the respective stem and dummy block when the dummy block is in the outermost position. The stud 78 is fixed relative to the dummy block by key 106. Similarly, the position of the stem 14 relative to the stud 78 is fixed by key 108. This positioning of the stud 78 in the stem and the dummy block also determines the space between the rear face 110 of the post of the valve member 40 and the forward face 112 of the recess 114 in the stud 78.

By determining the distance between the faces 110 and 112 the necessary physical characteristics of the spring 88 may be selected to determine the open and closed positions of the valve member 40 and also determine when the valve member 40 moves to its closed position. The spring member 88, as shown in FIG. 4, is in accordance with a preferred embodiment of the invention. The compression spring may be made of a material and designed to function at temperatures at which the extrusion press operates. The purpose of the spring 88 is to retain the valve member 40 in its open position at least until the metal billet 18 begins to upset and preferably until the upset metal billet is about to flow behind the valve member 40 in between surfaces 48 and 72 and thereby into the recess 46. By trial and error the preset loading for the spring 88 can be determined so as to control the closing of the valve 40 to its closed position.

It is appreciated that a variety of devices may be employed to function in the same manner as the compression spring 88, such as a solid block of resilient material, opposing truncated conical shaped spring washers and other like mechanical devices for resiliently biasing the valve member 40 to its outermost open position. It is also understood that the coiled spring may be arranged in other ways within the dummy block and relative to the valve. For example, the coiled spring may be mounted to surround the post 70 of the valve and bottom out on the stem or shoulder provided within the dummy block. By virtue of knowing the spacing between faces 110 and 112 the preset condition for the spring 88 can be readily determined such that when the spring is positioned between the faces 110 and 112, the desired spring value is provided to resist movement of the valve member 40 to its closed position until the desired moment. Such spring value is in essence pre-set for the intended use of the dummy block. The spring member may be of any material which is capable of functioning at the elevated temperatures, particulary in the range of 900° F. and greater. A preferred material for the spring is a nickel alloy sold under the trademark Inconel® X750. A compression spring of this material readily withstands the higher temperatures of the extrusion press and performs on a consistent basis over an extended period of time to reduce servicing of the dummy block.

The preset resistance value of the spring is selected to retain the valve member 40 in the open position shown in FIG. 4. As the stem 14 advances into the container 12 pressure on the face 44 of the valve member 40 is increased by abutting the face 116 of the metal billet 18 as it is sandwiched between the valve member 40 and the face 118 of the die 20. For the particular malleable metal, the billet 18 will upset at a reasonably consistent pressure based upon the temperature of the billet at the commencement of the extrusion. For example, an aluminum billet at a temperature of approximately 900° F. commences to upset at approximately 900 psi. In order to ensure a mechanical venting of the gases, the valve member 40 must remain open until at least after the billet has upset and preferably until the billet almost commences to flow to within the recess 46. At this point the spring 88 commences to collapse to allow the valve member 40 to move to its closed position. Preferably the valve member is used in conjunction with the normal degassing portion of the extrusion cycle. When the billet begins to upset, the degassing portion of the cycle is initiated. During degassing, the pressurized gases are primarily released from the forward region of the container close to the die 20. The mechanical venting system of this invention therefore supplements the degassing cycle by always ensuring that any pressurized gas in the rear region of the container is released.

Figure 5:
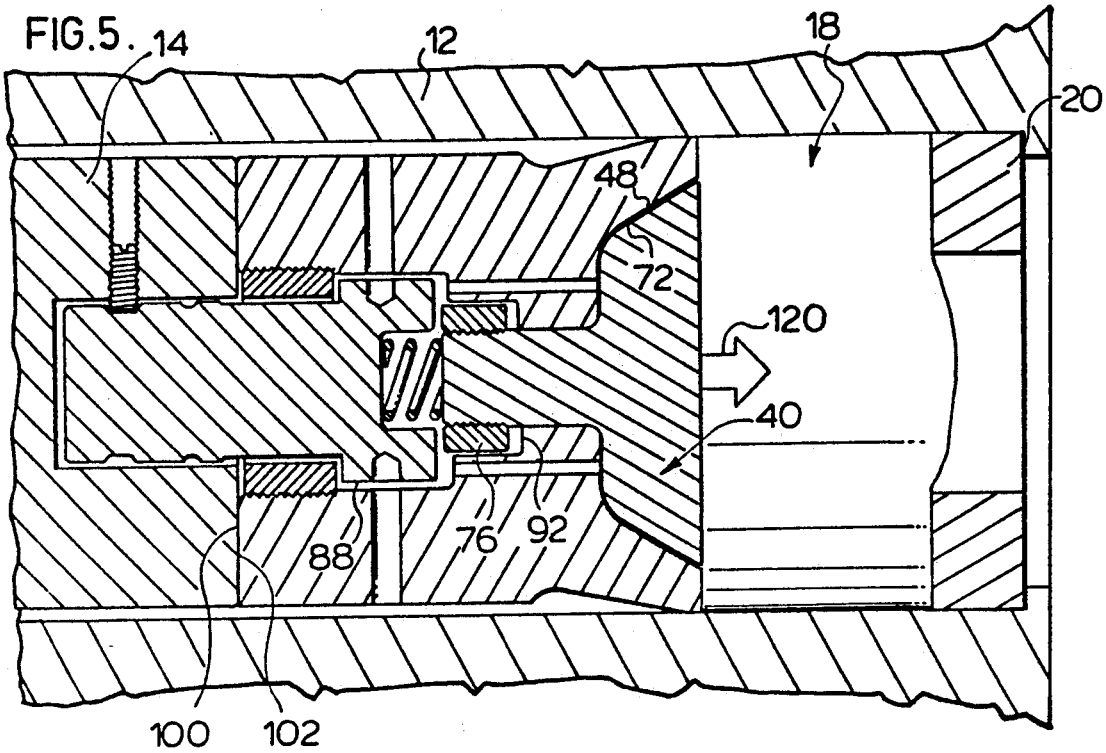
FIG. 5 is a section through the dummy block in the extruding position.

With reference to FIG. 5 the valve member 40 has moved to its closed position by pressing the billet 18 in the direction of arrow 120 to extrude the billet through the die 20. With the valve member 40 in the closed position, the spring 88 is compressed to the extent shown where the collar 76 has moved away from the shoulder 92. Correspondingly, the faces 100 of the stem and 102 of the dummy block abut one another to transfer the complete forces of the stem 14 advancement into the container 12. With the faces 48 and 72 of the dummy block body portion and valve member respectively abutting one another the valve is then closed to prevent metal flowing into the recess 46.

The spring member 88 also serves the purpose of locating the dummy block on the stud 78 relative to the stem 14. By pre-loading the spring 88, an outward pressure is exerted on the valve member 40 to tighten up the loose fit of the dummy block as it sits on the stud 78. Hence, the dummy block is allowed to float by virtue of some lateral movement relative to the fixed stud 78. But such lateral movement is only accomplished by a laterally directed force to overcome the tight fit within the components due to the outward force exerted by the spring member 88.

Figure 6:
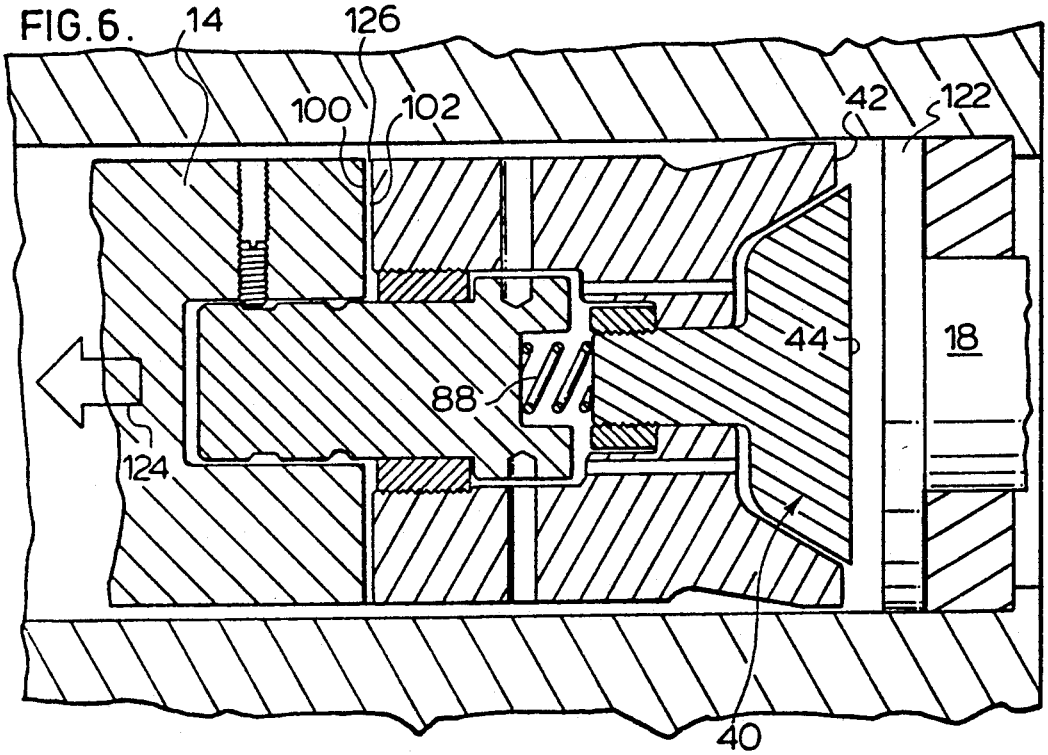
FIG. 6 is a section through the dummy block as it is being retracted from the butt of the extruded billet.

Another important purpose for the spring member 88 is shown in FIG. 6. After extrusion of the billet 18 which leaves the butt portion 122, the stem 14 is retracted in the direction of arrow 124. By retracting the stem 14 the space 126 between faces 100 and 102 opens to its fullest extent and which as already mentioned provides for the floating aspect of the dummy block in accommodating lateral movement relative to the stem. Furthermore, as the dummy block is backed away from the butt 122 of the billet 18 the spring 88 forces the valve member 40 outwardly towards its open position. This movement releases the butt from the annular face 42 of the dummy block and also assist in releasing the butt from the face 44 of the valve member. Furthermore, the forceful ejection of the valve member allows the dummy block annular portion 38 to relax and decrease slightly in diameter. Such slight reduction in block diameter facilitates withdrawal of the dummy block from within the container. Hence, the spring member also assists in the separation of the dummy block from the butt portion of the extruded billet 18 and its retraction from the container.

Figure 7:
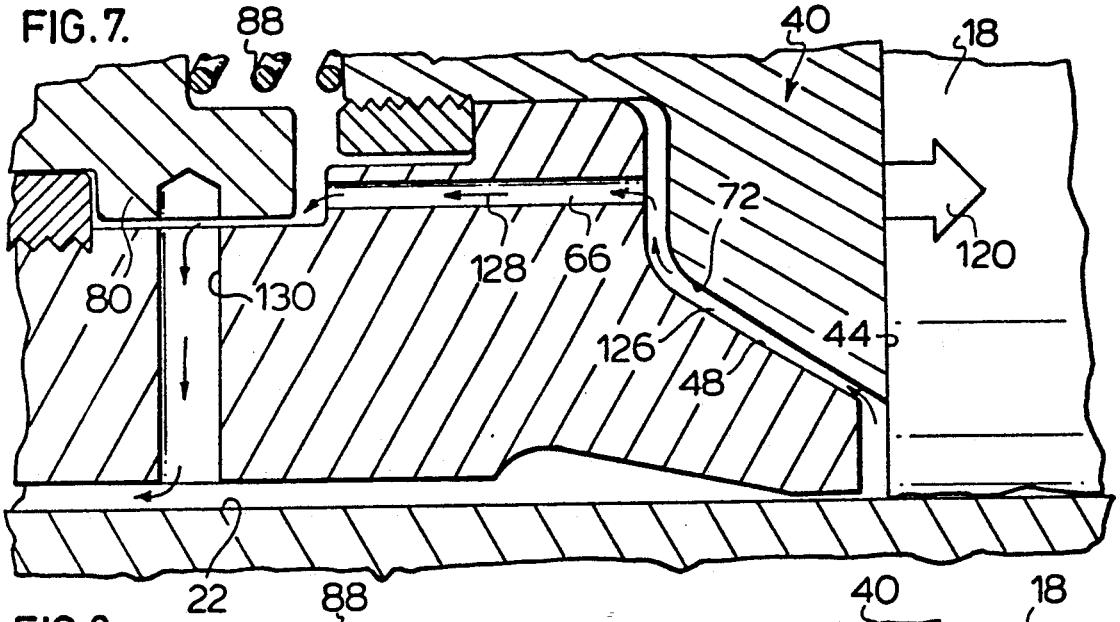
FIG. 7 is a partial section through the dummy block showing in exploded detail the mechanical venting of gases from the container.
Figure 8:
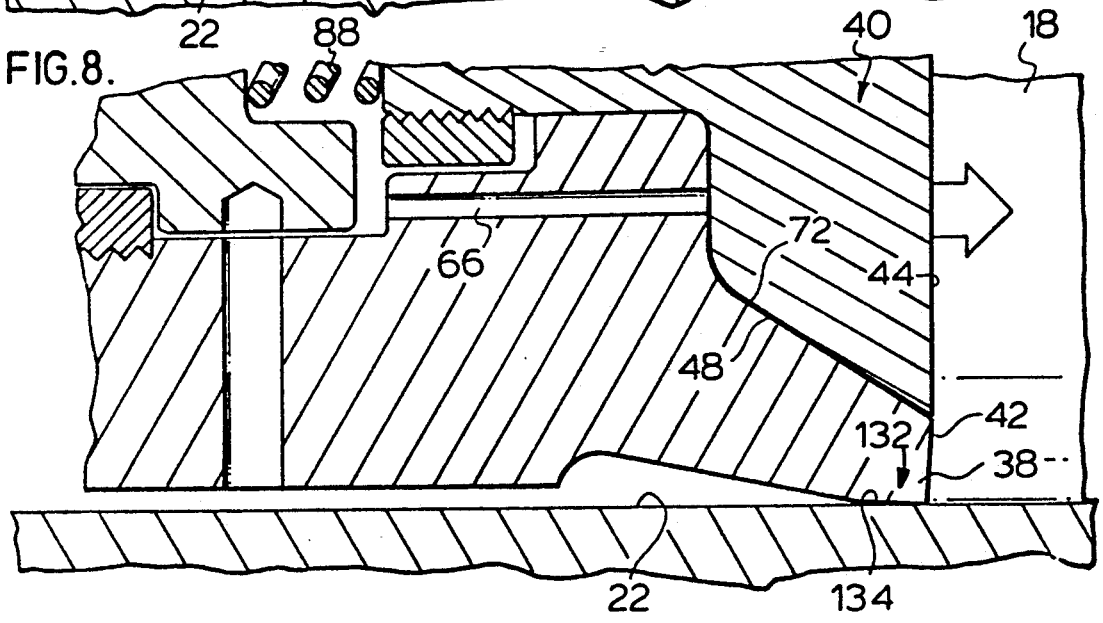
FIG. 8 is the same section as FIG. 7 with the dummy block in the extrusion position.

As shown in more detail in FIGS. 7 and 8 the venting of the gases from the container is demonstrated. The valve member 40 is shown with its face 44 abutting the billet 18 and is moved in the direction of arrow 120. The valve member 40 is in its open position to define an annular gap between the faces 48 of the dummy block and 72 of the valve member. As the dummy block continues to advance the metal billet commences to upset within the container 12 and starts to conform to the space of the container thereby filling the voids between the billet and the container surfaces, such as demonstrated at gap 90 with reference to FIG. 4. Normally at this stage in the extrusion cycle, the press is opened for the standard degassing step, before stem advancement is resumed.

Due to the resistance of the spring device 88, the valve member 40 is retained in its open position even after the degassing step which thereby continues to allow the gases to escape the voids in the chamber, as they are being filled by the upset billet 18, through the annular space 126 and through the dummy block in the direction of arrows 128 along for example, the respective channel 66. A radially extending bore 130 is provided in the dummy block to allow the gases as they pass by the stem flange 80 to escape rearwardly of the dummy block through the space between the stem and the interior surface 22 of the container cylinder to atmosphere. It should be noted that some gases may escape between the annular portion 38 of the dummy block and the container wall. However, as is appreciated, this space is not always entirely open because of a thin metal film which builds upon the container surface. Hence, the valve system of this invention always ensures a consistent release of gases from within the container. Therefore, without the application of a vacuum the dummy block according to this invention provides a mechanical venting of gases from the container before extrusion of the metal billet proceeds. Such mechanical venting of the gases is very effective in combination with the degassing cycle to remove sufficient volume of the gases from the container to avoid blistering in extruded product. Blistering, that is, air bubbles in the extruded product were a significant problem in extruding large complex sections and large hollow sections. Quite surprisingly, however, the use of the mechanical venting in accordance with this invention has virtually unlimited blistering in these shapes.

Other considerations in extruding the metal to reduce entrapped gases include tapering the billet in a rearward direction so that as the billet upsets the gases are voided in a rearward direction towards the dummy block 16 within the container. The resistance value of the spring member 88 is chosen or pre-set to resist movement of the valve member 40 to the closed position, as shown in FIG. 8, at least until the metal billet has commenced upsetting or preferably until the metal billet is about to flow through the space 126. At that time the pressure on the face 44 of the valve member is sufficient to overcome the resistive force of the spring member 88 and cause the valve member 40 to close and thereby engage face 48 of the dummy block with face 72 of the valve member. It has also been found that the mechanical venting system is particularly useful in extruding billets which have a sheared end portion. Usually such sheared portions are sloped which can entrap gases behind a standard dummy block, but by this invention, continue to be released. I addition, the mechanical venting also improves venting in conjunction with extruding multiple billets which are aligned serially in the container.

If desired, the face 72 may have a slight relief compared to face 48 so that as the valve member 40 is forced into the dummy block by the pressure exerted by the stem an annular expansion of the annular portion 38 of the dummy block is achieved in the direction of arrow 132. This ensures a complete seal between the outer edge 134 and the cylinder interior surface 22. As shown with the valve member 40 in its closed position the face 44 is flush with the face 42 of the dummy block to avoid material hanging up in the undercut portion 72 of the valve member 40. Furthermore, this flush fit of the face 44 with the face 42 assists in the separation of the dummy block from the butt 122 in the manner discussed with respect to FIG. 6.

The dummy block construction according to this invention provides a simple mechanical system to supplement and enhance the degassing of the container during the extrusion cycle. With the use of a resilient biasing member one or more valves such as described with respect the preferred embodiment may be provided in the face of the dummy block to effect release to atmosphere of the gases from the voids in the container. It is understood for example that two or more valves may be positioned symmetrically about the face of the dummy block. For example, four valves could be positioned in a circle about the face of the dummy block to expedite and ensure release of trapped gases from areas of the container prior to and at least until upset of the metal billet.

Although preferred embodiments of the invention are described herein in detail, it will be understood by those skilled in the art that variations may be made thereto without departing from the spirit of the invention or the scope of the appended claims.

We claim:

1. In an extrusion press for extruding through a dye extrudable metals, a mechanical venting device in a circular dummy block for venting gases from a circular container, said venting device comprising:

i) a circular shaped valve member provided in a front face of said dummy block, said valve member being moveable inwardly and outwardly of said dummy block from an open venting position to a closed position, ii) channel means in said dummy block and leading away therefrom to vent gases away from said valve and said open position, iii) said valve member having a sealing face which seals against a mating face of said dummy block, iv) said dummy block having means for guiding movement of said valve member into and out of said closed position, v) said valve member having a post portion, said dummy block having a bore through which said post portion extends, vi) said post portion having a rear face, means for locating movement of said valve member to said open position, said locating means being positioned on said post portion, vii) a connector stud being provided in said dummy block and extends rearwardly therefrom to provide connection to a reciprocal stem of said extrusion press, the improvement comprising:

viii) means for resiliently mechanically biasing said valve member to said open position, said mechanical biasing means being positioned between said post portion rear face and a front face of said stud, ix) said mechanical biasing means resisting movement of said valve member toward said closed position by virtue of said dummy block moving into said container and said valve member contacting a metal billet in said container and thereby being urged toward said closed position, x) said mechanical biasing means having a pre-set resistance value which resists movement of said valve member to said closed position at least until a metal billet in said container commences to upset and flow within said container at which moment force on said valve member due to said dummy block advancing into said container exceeds said resistance value of said biasing means.

2. In an extrusion press of claim 1, said valve member having a face portion which abuts a metal billet in said container as said dummy block advances thereinto.

3. In an extrusion press of claim 2, said dummy block having a circular recessed portion into which said circular valve member recedes and seats on moving to said closed position, said channel means being in communication with said recessed portion.

4. In an extrusion press of claim 3, said circular valve member having a plunger portion, said recessed portion having a central bore through which said post portion extends, said plunger having an under cut slopped surface defining said sealing face and said recessed portion having a corresponding sloped portion defining said mating face, said face portion of said valve member being flush with said front face of said dummy block when said valve member is in said closed position, said guide means contacting said post portion for guiding movement of said valve member.

5. In an extrusion press of claim 4, said dummy block having a longitudinal extruding central axis, said circular valve member with said post portion being centrally positioned of said dummy block central axis.

6. In an extrusion press of claim 1, said mechanical biasing means being a coil spring having pre-set spring value corresponding to said resistance value.

7. In an extrusion press of claim 5, a retaining means positioning said coil spring between said valve member rear face and a front face of said stud.

* * * * *